US011660243B2

(12) United States Patent
Kuperberg

(10) Patent No.: US 11,660,243 B2
(45) Date of Patent: May 30, 2023

(54) APPARATUS AND METHOD FOR AN EFFORTLESS TRANSITION TO A PRONE POSITION FOR PATIENTS SUFFERING FROM SARS-COV-2

(71) Applicant: Stephen J Kuperberg, New York, NY (US)

(72) Inventor: Stephen J Kuperberg, New York, NY (US)

( * ) Notice: Subject to any disclaimer, the term of this patent is extended or adjusted under 35 U.S.C. 154(b) by 0 days.

(21) Appl. No.: 17/873,048

(22) Filed: Jul. 25, 2022

(65) Prior Publication Data

US 2022/0354721 A1 Nov. 10, 2022

Related U.S. Application Data

(63) Continuation-in-part of application No. 16/501,487, filed on Oct. 29, 2015, now abandoned.

(51) Int. Cl.
*A61G 7/10* (2006.01)
*A61G 7/00* (2006.01)

(52) U.S. Cl.
CPC ..... *A61G 7/1057* (2013.01); *A61G 7/1015* (2013.01); *A61G 7/1019* (2013.01); *A61G 7/1055* (2013.01); *A61G 7/1013* (2013.01); *A61G 7/1049* (2013.01)

(58) Field of Classification Search
CPC ..... A61G 7/1057; A61G 7/1055; A61G 7/1051; A61G 7/1049; A61G 7/1015; A61G 7/1019; A61G 7/1013; A61G 2200/30; A61G 2200/32; A61G 2200/325; A61G 2200/327
USPC ..... 5/83.1, 85.1, 88.1, 81.1 R, 612, 600
See application file for complete search history.

(56) References Cited

U.S. PATENT DOCUMENTS 1,299,933 A * 4/1919 Greene ..... A61G 7/1015 5/85.1
1,876,832 A * 9/1932 Bancroft ..... A61G 7/1055 5/89.1
1,971,294 A * 8/1934 Bunker ..... A61G 7/1051 224/159
2,710,975 A * 6/1955 Stoen et al. ..... A61G 7/1055 5/84.1
3,246,346 A * 4/1966 Schmidt ..... A61G 7/0005 5/503.1
3,334,360 A * 8/1967 Hoxeng et al. ..... A61G 7/0005 5/503.1
3,701,170 A * 10/1972 Bond ..... A47K 3/001 5/81.1 R
3,959,832 A * 6/1976 Parsons ..... A61G 1/04 5/84.1
4,194,253 A * 3/1980 Ullven ..... A61G 7/1044 5/84.1
4,357,722 A * 11/1982 Thompson ..... A61G 7/008 5/606
4,627,119 A * 12/1986 Hachey ..... A61G 7/1015 5/85.1

(Continued)

*Primary Examiner* — Robert G Santos
(74) *Attorney, Agent, or Firm* — Patent Ventures, LLC

(57) ABSTRACT

The invention relates to a prone position device that is modular and has universal integration capability, for an effortless transition to a prone position in patients suffering from SARS-CoV-2 or any acute respiratory distress syndrome through the use of a mechanical means that may be fitted into a full spectrum of beds to support a multitude of resting positions for the patient.

17 Claims, 6 Drawing Sheets

(56) References Cited

U.S. PATENT DOCUMENTS 4,801,493 A * 1/1989 Ferziger ..... C03C 25/1095 442/139
4,843,665 A * 7/1989 Cockel ..... A61G 7/0005 5/81.1 R
4,982,462 A * 1/1991 Wada ..... A61G 7/0005 4/569
5,018,225 A * 5/1991 Fergni ..... A61G 7/0573 5/607
5,054,140 A * 10/1991 Bingham ..... A61G 7/0573 5/600
5,107,554 A * 4/1992 Garakani ..... A61G 7/1057 5/89.1
5,155,874 A * 10/1992 Kershaw ..... A61G 7/1046 5/81.1 T
5,239,713 A * 8/1993 Toivio ..... A61G 7/1044 177/144
5,659,905 A * 8/1997 Palmer, Jr ..... A61G 7/001 5/81.1 R
5,661,860 A * 9/1997 Heitz ..... A61G 7/05723 5/632
5,673,443 A * 10/1997 Marmor ..... A61G 7/001 5/85.1
5,708,993 A * 1/1998 Campbell ..... A61G 7/1019 177/144
6,006,376 A * 12/1999 Williamson ..... A61G 7/1046 5/81.1 R
7,062,804 B2 * 6/2006 Rouse ..... A61G 7/1051 5/88.1
7,293,303 B2 11/2007 Worrell
7,356,858 B2 * 4/2008 Summers ..... A61G 7/1096 5/89.1
7,895,688 B1 * 3/2011 Rowes ..... A61G 7/001 5/607
8,336,138 B2 * 12/2012 Newkirk ..... A61G 12/004 248/326
8,549,679 B2 * 10/2013 Tindall ..... A61G 7/1015 5/81.1 R
8,813,276 B2 * 8/2014 Lee ..... A61G 7/001 5/482
9,248,065 B1 * 2/2016 Tu ..... A61G 7/1046
9,456,944 B2 * 10/2016 Berg ..... A61G 7/1057
9,545,348 B2 * 1/2017 Britton ..... A61G 7/057
9,907,716 B2 3/2018 Miyashita et al.
10,398,612 B2 * 9/2019 Iida ..... A61G 7/0005
10,786,014 B2 * 9/2020 Ladner ..... A41B 13/06
10,869,797 B2 * 12/2020 Ringbjer ..... A61G 7/1051
2005/0177938 A1 * 8/2005 Steiner ..... E04H 15/04 5/120
2005/0283906 A1 * 12/2005 Summers ..... A61G 7/1015 5/86.1
2009/0013469 A1 * 1/2009 Johnson ..... A61G 7/0573 5/607
2009/0014483 A1 * 1/2009 Green ..... B65G 7/12 224/269
2012/0005837 A1 * 1/2012 Spahn ..... A61G 7/05784 5/706
2012/0204346 A1 * 8/2012 Billauer ..... A47C 13/005 5/2.1
2012/0304384 A1 * 12/2012 Scholz ..... A61F 7/00 5/81.1 R
2013/0081209 A1 * 4/2013 Young ..... A47C 27/063 5/739
2013/0115841 A1 * 5/2013 Ronner ..... D03D 15/258 28/165
2013/0160208 A1 * 6/2013 Davenport ..... A61G 7/018 5/612
2013/0276235 A1 * 10/2013 Kenalty ..... A61G 1/0287 5/627
2016/0174725 A1 * 6/2016 Takaoka ..... A47C 27/006 5/652.1
2020/0405554 A1 * 12/2020 Kuperberg ..... A61G 7/005
2022/0354721 A1 * 11/2022 Kuperberg ..... A61G 7/001

* cited by examiner

APPARATUS AND METHOD FOR AN EFFORTLESS TRANSITION TO A PRONE POSITION FOR PATIENTS SUFFERING FROM SARS-COV-2

FIELD OF THE INVENTION

The present invention relates to an apparatus and method for an effortless transition to a prone position, more particularly, a pronation device that is modular and has universal integration capability, for effectively alleviating acute respiratory distress disorder or SARS-CoV-2 through the use of a mechanical means that may be fitted into a full spectrum of beds or as a stand-alone device without the need of a bed, along with a method of use.

BACKGROUND OF THE RELATED ART

Severe acute respiratory syndrome coronavirus 2 (also known as, COVID-19/SARS-CoV-19) affects a patient's respiratory system. It causes inflammation and swelling in the throat and lungs. In mild or moderate cases of COVID-19, the inflammation leads to symptoms such as dry cough and sore throat. In severe cases, the inflammation causes fluid to build up in the lungs. The fluid in the lungs makes it extremely difficult to breathe. This in medical terms is called acute respiratory distress syndrome (ARDS).

While more research needs to be conducted, doctors have found a trusted source that the prone position helps patients with severe COVID-19. Prone allows the back of the lungs to expand fully. It can also help the patient cough up more of the fluid in their lungs and can improve the way oxygen travels through the body which leads to improved breathing capacity. Patients who are put in the prone position are carefully monitored. Medical staff usually has difficulty in placing the patients in the prone position for a set number of hours before transitioning them back to the supine position for a few hours. This process needs to be repeated over the course of several days if the patient is breathing better and can tolerate the treatment. In some cases, this has helped the patients avoid being intubated and placed on ventilators in the ICU.

The prone position has also been successfully used on COVID-19 patients who were using ventilators. Careful use of the prone position has been shown as a trusted source to improve the survival rate for ventilated patients. Much of the research that has been done isn't specific to COVID-19, but doctors are able to apply techniques, such as prone, that have been proven to help patients experiencing ARDS caused by other conditions.

The periodic turning of the patient in fixed intervals can exponentially reduce the contact pressure and greatly improve gas exchange to result consistently in improved oxygenation. The improvement of oxygenation during prone ventilation is multifactorial leading to the improved configuration between the lung and thorax. However, the periodic turning of a patient can be especially troublesome if the staff is doing so without the aid of a device, and even more so if the patient is large and heavy. A number of prone position apparatuses and methods have been provided in the background art, nevertheless, they differ from the present invention in that neither claim nor disclose an apparatus or method embodying a device for a prone position that can easily integrate into any resting environment; that can easily manipulate the position of a patient, and does not necessitate an installation or a motorized rig.

In addition, the background art does not disclose a portable prone position device configured to support pronation of a patient by achieving lift and rotation, with a rope and block-coupled support structure achieving intervening space between the bed mattress and support structure. Additionally, the background art does not disclose a portable device with a support structure disposed of with indentations and apertures adapted for housing and tracking the various lines and leads that may be in communication with a patient, while in the prone position. Pronation has been shown in numerous clinical studies to assist patients suffering from Acute Respiratory Distress Syndrome (ARDS) by improving oxygenation and reducing the duration of time spent on a mechanical ventilator. It accomplishes this by optimizing ventilator/perfusion relationships via redistribution of blood flow to under-perfused lung units and reducing the number of non-functioning alveoli. Pronation alters the pressure gradient, reducing the gradient between the ventral and dorsal parts of the lung. Pronation may reduce ventilator-induced overall stress (i.e. transpulmonary pressure and strain of lung parenchyma (i.e. tidal volume (V(T))/end-expiratory lung volume (EELV) ratio), which constitute major ventilator-induced lung injury determinants. Moreover, the background art does not disclose a device configured to support a patient into a prone position and prevent or mitigate decubitus ulcers in patients with long exposure to pronation.

One bed apparatus (Davenport et al., US 20130160208), discloses a bed frame with a pair of frame supports. Additionally, a lift mechanism disposed on the frame and operably connected to the pliable support material, which extends between the frame supports, is further disclosed. Moreover, the pliable support material only has a first resting position and a second resting position. However, Davenport is distinguished from the present invention in that the bed apparatus necessitates an elaborate installation comprising a bed frame with supports. Additionally, it requires a mechanized device disposed on the frame to control tension of the support material, and hence, only offers a limited number of resting positions. Moreover, the installation and mechanized rig prevent the assembly from being easily removed and re-installed onto another bed that may be accommodating a patient with need.

Thompson (U.S. Pat. No. 4,357,722) describes and claims a rockable frame comprising two longitudinally extending members supporting a pliable material, to which tension is applied by an actuator causing rotational movement of the rockable frame. Similar to Davenport and Johnson, Thompson requires a mechanized means, which does not support a multitude of resting positions. Additionally, as with Davenport and Johnson, Thompson requires a cumbersome installation of longitudinal members, along with extensive railings, impairing portability of the prone position device.

In view of the foregoing void, a need has arisen for an effortless transition to a prone position that does not require an elaborate installation or a motorized rig. In particular, a need exists for a prone position device that is modularized and that can be easily fitted onto any resting environments. It is not desirable to have a device installed onto a particular bed, and then not be able to easily remove and attach the device. The lack of portability presents significant challenges to proxy-health care providers, as well as care givers. Furthermore, a need exists for a prone position device in which the tension load is delivered by mechanical means, versus strictly electro-mechanical means. The use of pliable support operably connected to mechanical means, as opposed to a motor coupled to a controller, results in a more precise control of patient position—whether supination or pronation—in addition to offering a far wider repertoire of resting positions for a patient. Finally, a void in the art exists for a support structure or bed device configured to support a patient in a prone patient, while allowing for the traversal of vital tubing and lines from the prone patient in operable communication with medical monitoring and administering devices—designed to prevent dislodgement of the tubing and lines from the prone patient.

SUMMARY

The embodiments of the present invention relate to a device for prone position with mechanical means, and more specifically, the embodiments of the present invention relate to a prone position that is modular, easy to install and remove, and is not coextensive with a large installation, nor requires a motor output in order to manipulate the position of a patient suffering from SARS-CoV-2 or any other acute respiratory distress syndrome.

In general, in one aspect, the invention relates to a prone position device that is modular and has universal integration capability, for an effortless transition to a prone position in patients suffering from SARS-CoV-2 or any acute respiratory distress syndrome through use of a mechanical means that may be fitted into a full spectrum of beds to support a multitude of resting positions for the patient. The lack of an assembly with boards disposed with a motor output and rails provides portability and offers solutions to proxy-health care providers, as well as care givers, with respect to fitting and unfitting the device onto any bed or lack of bed. Furthermore, the present invention solves the problem of limited resting positions with the use of mechanical means, as opposed to strictly electro-mechanical means, for delivering or off-loading tension load onto the pliable support material. The use of a pliable support operably connected to mechanical means, as opposed to a motor coupled to a controller, results in a more precise control of patient position, in addition to offering a far wider repertoire of resting positions for a patient.

It is a further object to provide a prone position device in which the pliable support net is customized with selectively placed apertures. Apertures in the pliable net correspond to regions of a patient that are most prone to bed-sores, namely the sacrum, lumbar, trochanter, gluteal regions, and the heel/foot regions. The apertures, in addition to the pliability and tension manipulation of the net, all result in decreasing the contact surface pressure on the patient. Apertures may also be included that are dimensioned for the traversal of vital tubing and lines in order for a prone patient to be in operable communication with medical monitoring or administering devices, without the risk of tubing or line dislodgement. The material of the support net may be any pliable material—with the tensile strength to support the weight of a patient—and may further be impregnated with anti-septic ingredients.

Yet another object of the invention may include a modular bed board disposed with block and tackle pulley units on the front wall that may be coupled with a telescopic arm. When extended, the elevated arms allow the pliable net to be operably communicative with the elevated block and tackle, allowing for added support to a heavier-set patient laying in a recumbent, supine, or prone position on the support net. Other mechanical means may be configured in an elevated position compared to the height of the bed board to achieve comparable support of heavy-set patients.

Still, another object of the invention is to provide a method of use for the prone position device. Any care giver, proxy-health care provider, or person could fit the nets onto the bed boards and manipulate the position of the nets using the block and pulley mechanical means, or other mechanical means. The use of a pliable support operably connected to mechanical means, as opposed to a motor coupled to a controller, results in a more precise control of patient position, in addition to offering a far wider repertoire of resting positions for a patient. Furthermore, the lack of a bed assembly with motor disposed boards and rails affords the present invention with a modular and portable form factor. This portability allows the easy assembly and disassembly of the prone position device with mechanical means.

Various other objects, advantages, and features of the invention will become apparent to those skilled in the art from the following discussion, taken in conjunction with the accompanying drawings.

DETAILED DESCRIPTION

Figure 1A:
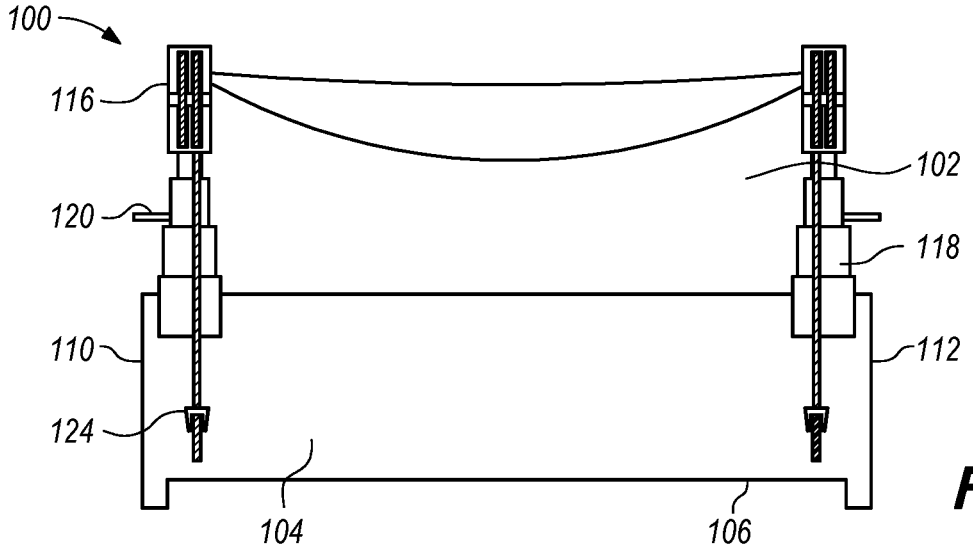
FIG. 1*a* shows a front perspective view diagram of the bed board according to aspects of the invention.

The following is a discussion and description of preferred specific embodiments of the portable prone position device as claimed, such being made with reference to drawings, and in particular to FIGS. 1 to 6 thereof, whereupon the same reference numerals are used to indicate the same or similar parts and/or structure. Such discussion and description are to illustrate and not to unduly limit the scope of the invention.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but, not other embodiments.

Referring to FIGS. 1-5, shown in detail is an apparatus for an effortless transition to a prone position for patients suffering from SARS-CoV-2 comprising a support structure with at least one pair of opposable embedded loops and at least one aperture dimensioned to traverse any one of vital lines from a patient in operable communication with any one of, or combination of a monitoring and/or therapeutic device, thereby preventing dislodgement of said vital lines, at least one block and tackle pulley, at least one rope lock mechanism integrated as part of a rope guide or the block and tackle pulley, at least one mount for securing the block and tackle pulley with an existing bed board, wherein the mount is an inverted U-shaped mount configured to securely rest on the existing bed board and the support structure in communication with the block and tackle pulley mounted on the bed board via a rope through the at least pair of opposable embedded loops, enabling lift or rotation of the support structure enabling supination or pronation of the patient.

Further yet, in a preferred embodiment of the invention An apparatus for an effortless transition to a prone position for patients suffering from a severe SARS-CoV-2/severe respiratory distress comprising, a support structure configured to fold along any point or series of points and with at least one pair of opposable embedded loops, a bed-board mounted on an existing bed-board or bed frame, and a block and tackle pulley mounted on the bed-board and in communication with the support structure via a rope through the at least one pair of opposable embedded loops on the support structure, enabling any one of lift or rotation of any point or series of points along the support structure enabling any one of supination or pronation of the patient.

In another embodiment of the invention, as shown in FIG. 1-5, A method for an effortless transition to a prone position for patients suffering from a severe respiratory distress comprising the steps of securing a block and tackle pulley onto at least one of a bed board, existing bed board, or existing bed frame with a use of at least one mount, threading a rope through the block and tackle pulley, guiding a free end of the rope through at least one rope guide, attaching the free end of the rope with a clamp or hook, hooking the clamp or hook to an embedded loop of a support structure housing a patient in a prone position, adjusting the height and/or rotation of the support structure along any point or series of points of the support structure by pulling the rope threaded through the pulley and in tensionable communication with the support structure and maintaining the height and/or rotation of the support structure using a rope locking mechanism, preventing the movement of the rope communicating the block and tackle pulley with the support structure, enabling supination or pronation of the patient.

Figure 1B:
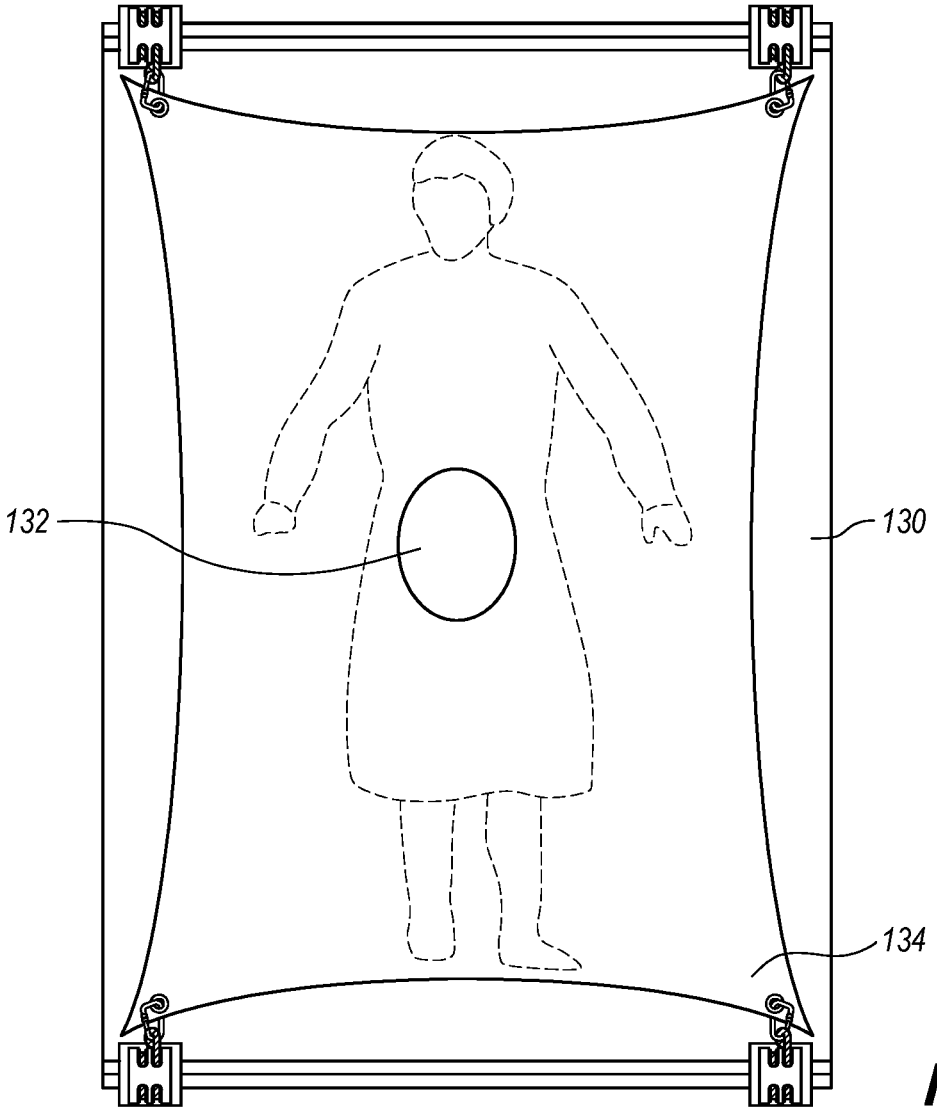
FIG. 1*b* shows a top elevation view diagram of the support net according to aspects of the invention.

Referring to the drawings in further detail, and particularly to FIGS. 1*a* and 1*b*, the prone position device is shown in a perspective view and elevation view. FIGS. 1*a* and 1*b* show one of many embodiments that have been conceived by the inventor. In its normal usage as a prone position device, the user may manipulate the position of a patient resting on the pliable net with the use of mechanical means, without the need for an elaborate assembly housing an electromechanical means for lifting the pliable net. Moreover, the lack of an elaborate assembly or motorized rig, allows for caregivers to easily assemble and disassemble the portable bed boards pre-assembled with a mechanical means, or easily affix the mechanical means onto a pre-existing bed frame, and hook a rope threading through the mechanical means onto a pliable support net with embedded loops. The apparatus, as shown in FIG. 1*a* and FIG. 1*b*, may comprise of a pre-assembled bed board with block and tackle pulley, and a pliable support net with aperture and embedded loop, respectively.

Further yet in an embodiment of the invention, the block and tackle pulley is coupled to a telescopic member disposed on a wall of the bed board, thereby when elevated, elevating the height of the block and tackle pulley and tensionable engagement with the support structure via the embedded loop. Additionally, the support structure further comprises at least one stress-relief aperture and is in tensionable communication with the block and tackle pulley by a rope threaded through the said block and tackle pulley and hooked to the embedded loop of the support structure by an attachment. In a preferred embodiment of the invention, the support structure further comprises embedded or surface-coated antibiotic agents for the prevention or mitigation of decubitus ulcers or any other open wound. The support structure further comprises material resulting from the polymerization of chloroprene.

Now referring to FIG. 1*a*, the pre-assembled and portable bed board 100 may comprise a top wall 102, front wall 104. bottom wall 106, back wall 108, and left 110 and right 112 side walls. While preferred embodiments may have flat walls, generally forming a bed board rectangular in shape and matching the dimensions of a traditional, health-care facility-issued bed frame, other shaped walls may be embodied. Bed board walls with pitched, circular, or elliptical shapes may be embodied, without departing from the scope of the invention.

In an exemplary embodiment, as shown in FIG. 1*a*, the top wall 102 may house a rope guide 114 that has dimension to guide a rope from the mechanical means, such as a block and tackle pulley 116, to be in operable communication with at least one embedded loop 206 of the support net 130. In an alternative embodiment, not shown in FIG. 1*a*, the rope guide 114 may be in the form of a through-wall of the bed board 100 and dimensioned to guide the rope from the mechanical means, such as the block and tackle pulley 116, to be in operable communication with the embedded loop 206 of the support net 130. Other embodiments may have a telescopic arm 120 coupled to the base of a block and tackle pulley 116, when extended, have a rope guide 114 disposed of thereon. Other embodiments may have a foldable or retractable rope guide disposed on the extended telescopic arm 120. Still, other embodiments may not have a rope guide 114, rather, the patient-end of the rope may directly communicate with the embedded loop of the pliable support net 130.

In continuing reference to FIG. 1*a*, the front wall 104 may house a block and tackle pulley 116, as the means for causing mechanical lift of the pliable support net 130, on both sides of the front wall 104 bed board 100. Other embodiments may include any number of block and tackle pulleys 116 on front wall 104 of the bed board 100, without departing from the scope of the invention. The block and tackle pulley 116 may extend from the surface of the front wall 104 of the bed board 100 by a hinge point. In alternate embodiments, the extended hinge point may be an articulating arm, allowing for the 180-degree rotation of the block and tackle pulley 116 in at least one axis of motion against the front wall 104 of the bed board 100. In another alternative embodiment, the block and tackle pulley may be disposed flush against the surface of the front wall 104 of the bed board 100. In yet another alternative embodiment, the block and tackle unit 116 may be housed on the top wall 102 of the bed board 100 by an inverted u-shaped clamp 204.

As shown in FIG. 1*a*, some embodiments may include a block and tackle pulley unit 116 that is disposed on a base 118 housed on the top wall 102 of the bed board 100 with a telescopic arm 120. The extension of which, allows for the raising and lowering of the block and tackle pulley unit 116, ranging from the top height of the bed board 100 to up to 3-5 feet above that height. The raising of the block and tackle pulley unit 116 allows for the stable support of a heavier-set patient laying in a recumbent position on the pliable support net 130, during the initial lift and manipulation of the patient's position by adjusting the tension on the pliable support net 130 by the block and tackle pulley unit 116. The base 118 housing the telescopic arm 120, coupled to the block and tackle pulley unit 116, may be disposed on the top wall 102 of the bed board 100 by an inverted u-shaped clamp 122. The raising of the telescopic arm 120 may be done manually by lifting the block and tackle pulley unit and locking it in a desired vertical height by a pin and loop lock. Other embodiments may have an electro-mechanical means disposed on the base 118, top wall 102 of the bed board 100, or the front wall 104 of the bed board, for the raising and lowering of the telescopic arm 118 coupled to the block and tackle pulley unit 116.

Although not shown in FIG. 1*a*, the block and tackle pulley unit 116 may be coupled to a vertical track disposed on the front wall 104 of the bed board 100. The block and tackle pulley unit 116 may slide up and down in a vertical direction along the vertical track, that may extend as high as 3-5 feet above the top height of the top wall 104 of the bed board 100. The caregiver may manually adjust the height of the block and tackle pulley unit 116 along the vertical track, and then lock it at a preferred height using a pin and lock mechanism. Other embodiments may include an electromechanical means disposed on the top wall 102, front wall 104, or the block and tackle pulley unit 116 itself, for the raising and lowering of the block and tackle pulley unit 116 along the vertical track.

Although not shown, an alternative embodiment of the mechanical means for causing lift and rotation of the recumbent patient may include a winch. The winch may be disposed above the bed board 100, threaded with several feet of wire or reinforced cloth rope, in communication with the pliable support net 130. On the lateral side of the winch is affixed a manual rotor with a handle, which is connected to the rotational axis of the winch. This affords the user the ability to wind the rope, and thereby exert an oppositional force on the pliable support net 130 causing lift and rotation of the patient. An alternative embodiment of the winch may be coupled to an electromechanical motor driving the rotation of the winch, thereby pulling the rope taut or releasing it respectively. The motor may be housed within the winch or on the top wall 102 of the bed board 100, or front wall 102 of the bed board 100, the control circuitry of which may be housed on an interface display, console, or switch. In a preferred embodiment, a load brake that latches onto the pawl of a ratchet and pawl housed within the mechanical means of lift and adjustment may be used by the user to stop the pulling mechanism and rest it in the desired position once completing the engagement. This process is reversible by disengaging the load brake.

Alternatively, a rope lock mechanism 124 disposed on the winch or bed board may be used to lock the rope in position, preventing further rotation of the rotor housed within the winch. In an exemplary embodiment, the winch may be elevated by telescoping rectangular bars, or alternatively, it may be stationary and disposed on the top wall 102 of the bed board at a patient level. In yet another alternative embodiment, a stationary winch housing may be disposed of as part of an inverted u-frame, elevated in a fixed position above the top wall 102 of the bed board 100.

In an alternative embodiment for causing patient lift and rotation, a gantry hoist may be used in communication with a pliable support net. A gantry hoist, disposed within an inverted u-shaped frame, elevates the gantry hoist in place above the top wall 102 of the bed board 100. The gantry hoist may be in operable communication with the embedded loops of the pliable support net 130, thereby delivering tension load to the pliable material and affecting the lift and rotation of the patient. In yet another embodiment, a pneumatic system in communication with the pliable support net 130 may be used to effectuate lift and rotation.

Still referring to FIG. 1*a*, in a preferred embodiment, the front wall 104 of the bed board 100 may house a rope locking mechanism 124 to lock the sliding of the rope, in order to prevent movement of the wheel unit 306 of the block and tackle pulley 116 and preserve the specific tautness of the pliable support net 130. Preserving the specific tautness of the pliable support net 130 will maintain the preferred position of the recumbent patient. The rope locking mechanism is disposed on the front wall 104 of the bed board 100, situated below and in line with the block and tackle pulley 116. Other embodiments may include a bed board 100 with a rope locking mechanism 124 integrated within a rope guide 114. Alternatively, the rope locking mechanism 124 may be integrated within the housing of the block and tackle pulley 116, whereby a rope locking mechanism is in direct communication with the wheel unit 306 of the block and tackle pulley 116, or integrated within the housing of the block and tackle pulley 116 and not in direct communication with the wheel unit 306.

In alternative embodiments, while not shown in FIG. 1*a*, the front wall 104 of the bed board 100 may house an electro-mechanical means configured for movement of the wheel unit 306 of the block and tackle pulley 116 in order to deliver a mechanized means for loading and off-loading tensionable communication to the pliable support net 130. The electro-mechanical means may be integrated within the housing of the block and tackle pulley 116. Alternatively, the electro-mechanical means may be disposed remote from the block and tackle pulley 116 and may be disposed on the front wall 104 or back wall 108 of the bed board 100. The controller for actuating the electro-mechanical means may be integrated on the housing for the electro-mechanical means, or may be disposed remotely from the housing for the electro-mechanical means, on the top wall 102 of the bed board 100, front wall 104 of the bed board 100, console, or an interface display.

Now in reference to FIG. 1*b*, a top elevation view of the pliable support net in accordance with an aspect of the invention is shown. In a preferred aspect of the invention, the pliable support net 130 may be comprised of pliable, elastomeric, and hypo-allergenic material. The pliable support net 130 may be open mesh or a contiguous mat, and the mesh or mat size thereof must be such as to allow the mat or net to conform to the shape of the patient. The net or mat may be made of heat-settable thermoplastic material with "memory" such that it does not take a substantially permanent formation under a specific patient load.

The pliable support net 130 may have at least one aperture 132 in designated regions of the support net 130. Apertures 132 serve to alleviate contact pressure in regions traditionally associated with decubitus ulcers: sacrum, lumbar, trochanter, gluteal, and heel/foot regions, etc. Designated apertures 132 of varying sizes may accommodate patients of varying sizes. Additionally, support nets 130 may have varying sizes to accommodate patients of varying sizes, along with beds of varying sizes. Alternate aspects of the invention may be for a pliable support net 130 with multiple apertures 132 corresponding to the aforementioned contact pressure regions. In other alternate aspects, the pliable support net 130 may appear as one contiguous piece, comprising at least one break-away aperture 130 located at a designated contact pressure region. In this embodiment, caregivers could have the choice of removing break-away apertures 132 as the caregiver sees fit. In yet other embodiments, the tensile strength of the support net 130 may vary across the surface of the net 130, depending on the load-bearing regions.

In a preferred embodiment, the pliable support net 130 may be impregnated, coated, embedded, lined or double layered with an antibiotic of proven safety and efficacy. The antibiotic may be coupled with cream, or other viscous material, for the uniform distribution over the surface of the net 130. Additionally, in an alternative embodiment, the support net 130 may be impregnated, coated, embedded, lined, double-layered, or spread with any ulcer therapeutic or prophylactic of proven safety and efficacy.

In a preferred embodiment, the pliable support net 130 may have reinforced embedded loops 134 on the corners of the support net 130, wherein the loops 134 have the dimension to hook a rope terminus in order for the embedded loops 134 to be in tensionable communication with the block and tackle pulley 116, or other mechanical means. The means for hooking a rope terminus to the embedded loop 134 may be a carabineer, S-hook, or any loop clamping means. The tensionable communication allows for a user or caregiver to mechanically adjust the tautness of the support net 130 by pulling the rope threaded over the wheel unit 306 of the block and tackle pulley 116, and hence, the position of a recumbent patient. In alternate embodiments, an electro-mechanical means may be disposed on the front wall 104, or top wall 102 of the bed board 100, allowing for a mechanized means for delivering the tensionable communication to the support net 130.

Figure 2:
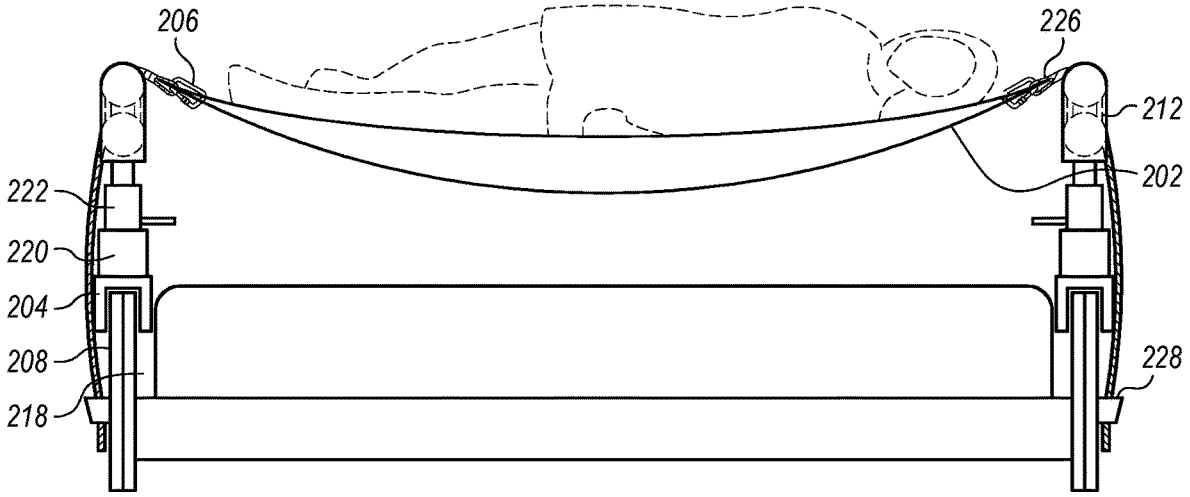
FIG. 2 shows a side perspective view of the prone position device according to aspects of the invention.

FIG. 2 shows a side elevation view of the integrated apparatus. The position of the support net 202 in relation to the bed board 208, along with a preferred configuration of embedded loop 206 and block and tackle 212 rope communication is shown. In a primary embodiment, each block and tackle 212 will communicate with its respective embedded loop 206, loading and unloading tension on each corner of the support net 202, for stable and precise control of a recumbent patient.

As shown in FIG. 2, an exemplary embodiment may include an inverted u-shaped clamp mount 204 to mount the top wall 102 of the bed board 208 with the existing bed frame 218. The clamp mount 204 may be an individual component disposed on the top wall 102 of the bed board 208 and dimensioned to house the base 220 for the telescopic arm 222 integrated with the block and tackle pulley unit 212. Other embodiments may include a clamp mount 204 integrated with the base 220 and block and tackle pulley unit 212 as a single integrated unit to be disposed on the top wall 102 of the bed board 208. Other embodiments may include clamp mounts 204 integrated with a stationary elongated member disposed with a block and tackle pulley unit 212. In yet other embodiments, not shown, the inverted u-shaped clamp mount may span the entire length of the top wall 102 of the bed board 208 and all of the clamp mount 204 embodiments mount over the top wall of the existing bed frame 218 and secured by bolt. Although not shown in FIG. 2, a horizontally-spanning clamp mount may be integrated with a base and a housing for a telescopic inverted u-shaped bar disposed with the winch or hoist mechanical means for lift and adjustment of the patient. Other embodiments may include a horizontally-spanning clamp mount integrated with a base for a stationary inverted u-shaped bar disposed with the winch or hoist mechanical means for lift and adjustment of the patient. Both horizontally-spanning clamp mount embodiments may be mounted on the existing bed frame 218 by hanging over the top wall of the bed frame 218 and securing with bolts.

While not shown in FIG. 2, the portable bed board 208 may be mounted to a bed frame 218 with the use of a frame mount disposed on the back wall 216 and operably connected to an embedded loop 206 of a support net 202 through a block and tackle pulley 212. In the present example, the bed board 208 may be mounted on a bed frame, and easily un-mounted. The frame mount is configured to allow a flat surface of the back wall 216 of the bed board 208 to be disposed flush against a flat surface of an existing bed frame 218. Alternatively, the frame mount disposed on the back wall 216 of the bed board 208 may be configured with articulation to allow the bed board 208 to move in at least one axis of motion versus the flat surface of the existing bed frame 218.

In other examples, also not shown, the bed board 208 may be fitted with a support base on the bottom wall 106 of the bed board 208, allowing for the bed board 208 to support the weight of a patient in a recumbent position, without the need for a bed or bed frame. In alternative embodiments, the components of the apparatus for an effortless transition to a prone position for patients suffering from SARS-CoV-2 or any other severe respiratory distress may be individually assembled onto an existing foot board and head board of a bed frame 218 directly, obviating the need for a pre-assembled portable bed board 208. The mechanisms for causing lift and positional shift of a patient may be the same irrespective of embodiments—pre-assembled bed boards or direct component assembly onto a bed frame.

In continuing reference of FIG. 2, the pliable support net 202 may have reinforced embedded loops 206 on the corners of the support net 202, wherein the loops 206 have dimension to hook a rope terminus in order for the embedded loops 206 to be in tensionable communication with the block and tackle pulley 212. The tensionable communication allows for a user or care giver to mechanically adjust the tautness of the support net 202 by pulling the rope threaded over the wheel unit 306 of the block and tackle pulley 212, and hence, the position of a recumbent patient. In alternate embodiments, an electro-mechanical means 306 may be disposed on the front wall 104 of the bed board 208, allowing for a mechanized means for delivering the tensionable communication to the support net 202.

In a preferred embodiment, a user may secure the bed board 208 to a bed frame 218 with the use of a frame mount or clamp mount 204. The user may thread a standard rope through one block and tackle pulley 212 and align the rope within an inlet of the wheel unit 306. The free end of the rope may then be guided through a corresponding rope guide 210 to be hooked onto its respective embedded loop 206 of the pliable support net 202 by means of a hook 226. In a preferred means for hooking the free end of the rope from the rope guide, 210 to the embedded loop 206 of the support net 202 may be comprised. Other means may include an S-hook, rope knot, or any small form factor fastener. The patient resting on the support net 202 may have his or her position adjusted by pulling the rope threaded through a wheel unit 306 of a block and tackle pulley 212, which causes a change in tension in the pliable support net 202.

Although not shown in FIG. 2, a rope locking mechanism 228 housed on the front wall 104 of the bed board 208 locks movement of the rope, and hence the wheel unit 306 of the block and tackle pulley 212. In alternative arrangements, the rope locking mechanism 228 may be disposed of within the housing of the block and tackle pulley 212. Based on manipulation of the rope from any of the four block and tackle pulleys 212, each housed on each corner of the bed board 208, or mounted on each corner of the top wall 102 of the bed board 208, the lift and adjustment of support net 202 may be effectuated with stability and exact precision.

While not shown in FIG. 2, alternative embodiments may include a user securing a bed board 208 with adjustable height to an existing footboard and headboard of a bed frame. Adjusting height may be caused by a longitudinal member housed within the side walls 110, 112 of the bed board 208 that may be extended to match the height of the existing bed frame. Adjusting height may also be caused by a horizontal member housed within the bottom wall 106 of the bed board 208, extending to match the dimensions of a bed frame. In yet another embodiment, adjusting height may be caused by a horizontal member adjoined to a base with a large surface area, housed within the bottom wall 106 of the bed board 208, extending to match the dimension of a bed frame. Other embodiments may include a user configuring the bed boards 208 with an extending base portion from the bottom wall 106 without the need for an existing bed frame or mattress. The extending base portion has a large enough surface area and counter-weight in order to support the weight of a patient, even without the need for the bed board 208 to be secured to an existing bed frame or mattress.

In an exemplary embodiment, as shown in FIG. 2, a block and tackle pulley unit 212 that is disposed on a base 220 housed on the top wall 102 of the bed board 208 with a telescopic arm 222 may be included. The extension of which, allows for the raising and lowering of the block and tackle pulley unit 212, ranging from the top height of the bed board 208 to up to 3-5 feet above that height. The raising of the block and tackle pulley unit 212 allows for the stable support of a heavier-set patient laying in a recumbent position on the pliable support net 202, during initial lift and manipulation of the patient's position by adjusting the tension on the pliable support net 202 by the block and tackle pulley unit 212. The base 220 housing the telescopic arm 222, coupled to the block and tackle pulley unit 212, may be disposed on the top wall 102 of the bed board 208 by an inverted u-shaped clamp 204. The raising of the telescopic arm 222 may be done manually by lifting the block and tackle pulley unit 212 and locking it in a desired vertical height by a pin and loop lock. Other embodiments may have an electro-mechanical means disposed on the base 220, top wall 102 of the bed board 208, or the front wall 104 of the bed board 208, for the raising and lowering of the telescopic arm 222 coupled to the block and tackle pulley unit 212.

In a preferred embodiment of the invention, an apparatus for an effortless transition to a prone position for patients suffering from SARS-CoV-2 comprises of a support structure with at least one pair of opposable embedded loops and at least one aperture dimensioned to traverse any one of vital lines from a patient in operable communication with any one of, or combination of a monitoring and/or therapeutic device, thereby preventing dislodgement of said vital lines, at least one block and tackle pulley, at least one rope lock mechanism integrated as part of a rope guide or the block and tackle pulley, at least one mount for securing the block and tackle pulley with an existing bed board, wherein the mount is an inverted U-shaped mount configured to securely rest on the existing bed board and the support structure in communication with the block and tackle pulley mounted on the bed board via a rope through the at least one pair of opposable embedded loops, enabling lift or rotation of the support structure enabling supination or pronation of the patient.

Further yet in a preferred embodiment of the invention, an apparatus for an effortless transition to a prone position for patients suffering from a severe SARS-CoV-2/severe respiratory distress comprising, a support structure configured to fold along any point or series of points and with at least one pair of opposable embedded loops, a bed-board mounted on an existing bed-board or bed frame and a block and tackle pulley mounted on the bed-board and in communication with the support structure via a rope through the at least one pair of opposable embedded loops on the support structure, enabling any one of lift or rotation of any point or series of points along the support structure enabling any one of supination or pronation of the patient. Additionally, the above-mentioned apparatus may be used to treat any condition wherein the patient is suffering from respiratory distress. The prone position improves oxygenation of the body, improves respiratory mechanics, homogenizes the pleural pressure gradient, the alveolar inflation, and the ventilation distribution, increases lung volume and reduces the number of atelectatic regions, facilitates the drainage of secretions, and reduces ventilator-associated lung injury.

Although not shown in FIG. 2, the block and tackle pulley unit 212 may be coupled to a vertical track disposed on the front wall 104 of the bed board 208. The block and tackle pulley unit 212 may slide up and down in a vertical direction along the vertical track, that may extend as high as 3-5 feet above the top height of the top wall 104 of the bed board 208. The caregiver may manually adjust the height of the block and tackle pulley unit 212 along the vertical track, and then lock it at a preferred height using a pin and lock mechanism. Other embodiments may include an electromechanical means disposed on the top wall 102, front wall 104, or the block and tackle pulley unit 212 itself, for the raising and lowering of the block and tackle pulley unit 212 along the vertical track.

Also not shown in FIG. 2, alternate embodiments may include users securing the individual components of the prone position device directly on the footboard and headboard of a bed frame, obviating the need for a bed-board 208. In such an embodiment, a user may secure components, such as the rope guide 210, block and tackle pulley 212, clamp mounts 204 or frame mounts, hooks 226 for communicating with the embedded loop 206 of a support net 202, rope locking mechanism 228, telescopic base 220, and telescopic arm 222. In still a further embodiment, the tension-causing mechanism is similar to those of the bed-board embodiments of the apparatus, whereby a rope is threaded through a wheel unit 306 of a block and tackle pulley 212 and operably connected to an embedded loop 206 of a pliable support net 202.

In alternate embodiments, also not shown in FIG. 2, the tension of the support net 202 may be caused by a wheel unit 306 of the block and tackle pulley 212 coupled to power means. A power means may be disposed on the front wall 104 of the bed board 208, or may be integrated within the housing of the block and tackle pulley 212, and coupled to a control circuit. A control circuit may be disposed of on the front wall 104 of the bed board 208. Alternatively, a control circuit may be disposed of within the range of patient reach in order for a patient to control tension and adjustment of the support net 202 positions. In yet another alternative embodiment, the control circuit may be a user interface display, as part of a bed board display, user device display, console display, and hand-held device display. The control circuit may have a patient position library with a pre-defined program of user-specific actuation of the power means. In other embodiments, the control circuit may be integrated within a home or facility Internet of Things network or a remote server, in order to enable intelligent automation of the power device based on user-specific contextual data. For instance, a user may wear an accelerometer which relays patient movement data to inform the power device for actuation if necessary. Moreover, a RFID tag may be embedded within the wheel unit of the block and tackle pulley, relaying patient movement data to inform the power device for actuation if necessary.

Figure 3:
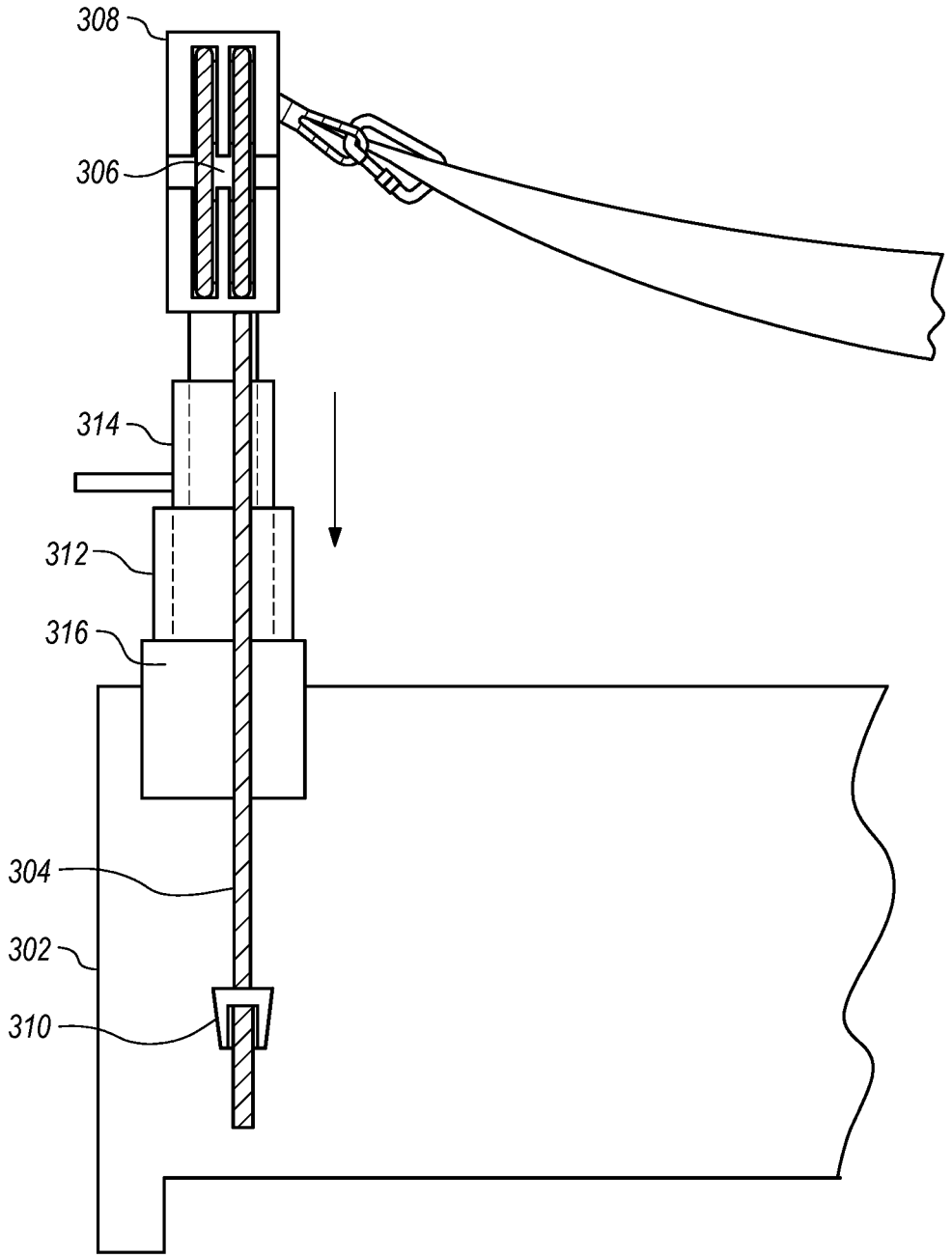
FIG. 3 shows an enlarged perspective view of the block and tackle pulley according to aspects of the invention.

FIG. 3 shows a fragmentary view of the block and tackle pulley unit in accordance with an aspect of the invention. Shown in FIG. 3, is the left-hand section of a portable bed board 302. In a preferred embodiment, the patient resting on the support net 202 may have his or her position adjusted by pulling the rope 304 threaded through a wheel unit 306 of a block and tackle pulley 308, which causes a change in tension in the pliable support net 202. The rope locking mechanism 310 housed on the front wall 104 of the bed board 302 locks movement of the rope 304, and hence the wheel unit 306 of the block and tackle pulley 308. Based on manipulation of the rope from any of the block and tackle pulleys 308, each housed on each corner of the bed board 302, the lift and adjustment of support net 202 may be caused with exact precision.

In an exemplary embodiment, the block and tackle unit 308 is shown in FIG. 3 as disposed on a base 312 clamp mounted on the top wall 102 of the bed board 302 with a telescopic arm 314. The extension of which, allows for the raising and lowering of the block and tackle pulley unit 308, ranging from the top height of the bed board 302 to up to 3-5 feet above that height. The raising of the block and tackle pulley unit 308 allows for the stable support of a heavier-set patient laying in a recumbent position on the pliable support net 130, during the initial lift and manipulation of the patient's position by adjusting the tension on the pliable support net 130 by the block and tackle pulley unit 308. The base 312 housing the telescopic arm 314, coupled to the block and tackle pulley unit 308, may be disposed on the top wall 102 of the bed board 302 by an inverted u-shaped clamp 316. The raising of the telescopic arm 314 may be performed manually by lifting the block and tackle pulley unit 308, and locking it in a desired vertical height by a pin and loop lock. Other embodiments may have an electro-mechanical means disposed on the base 312, top wall 102 of the bed board 302, or the front wall 104 of the bed board 302, for the raising and lowering of the telescopic arm 314 coupled to the block and tackle pulley unit 308.

In continuing reference to FIG. 3, an exemplary embodiment may include on each corner of the bed board 302, a metal u-shaped clamp 316 affixed as a metal bracket with 4 screws and having dimensions of 2-4 inches in width, 6-12 inches in height, 4-6 inches in depth with size variability capable of meeting size requirements of various bed frames 318. The clamp 316 may be disposed with a base 312, housing the telescopic arm 314 and the block and tackle pulley unit 308. The block and tackle pulley unit 308 may have a half-cylinder "closure" which can be locked into place and comprise a "swivel open" design for servicing. Inside the closure lies a series of two sets of two parallel and closely adjacent pulley wheel units 306, or "blocks". Alternatively, a single pulley may be used. The size of the pulley wheel unit 306 may be approximately 2-6 inches in diameter. Threaded through the circuit of the four pulleys is wire, metal, or reinforced cloth rope. The diameter of the rope may be 0.5-2 inches. One end of the rope exits on the external side of the bed frame 318 as the free end and is held by the user, who pulls the rope toward the patient to apply tension. One embodiment may include an ergonomic rubber handle encircling the free/user end of the rope to allow for secure grasping (such as on the end of a mop). Another embodiment may allow for a rubber ring on the free/user end of the rope to allow for secure grasping.

In an exemplary embodiment, after pulling to apply tension to achieve the desired height of the patient, a self-locking mechanism exists such that when the user has completed the engagement, it can safely remain in the desired position. The safety rope lock 310 will be achieved with a load brake housed within a load brake fixture housed on the block and tackle system. In one embodiment, the user rapidly changes the direction of the rope activating the brake. Alternatively, the load brake may be applied when the user presses a switch or lever on the outer surface of the load brake fixture. There is also a release on the self-locking mechanism such that when the user wishes to release tension on the rope, the load brake is disengaged with a switch or lever. The rope then unfurls, and tension is released by the user to lower the patient back to the resting position. In other embodiments, the rope lock 310 may be disposed on the front wall 104 of the bed board 302.

Still in reference to FIG. 3, in accordance to a preferred aspect of the invention, on the patient side of the apparatus, the free end of the rope 304 may be guided through a rope guide 210 affixed on the telescopic arm 314 or the top wall 104 of the bed board 302. The free end of the rope may be attached with an embedded ring 228 onto which a variety of hooks 226 or carabineers can be attached. The hook 226 may then be attached to the embedded loop 206 of the pliable support net 202. In order to overcome the weight of a heavy-set patient, the block and tackle pulley system 308 may be activated from an elevated position with respect to the heavy-set patient to be hoisted. In this embodiment, the elevated position may be implemented by adjusting the height of the block and tackle pulley system 308 by a telescopic arm 314. When not in the elevated position, the block and tackle pulley unit 308 lies low to the bed board 302, allowing for safely and precisely effectuating lift and adjustment of a normal weight patient. When the user wishes to engage the system, the height adjustment is increased by first pulling upward on the telescoping block and tackle pulley unit 308 and inserting a "key" pin in the desired hole to lock a preferred elevated height of a patient. Once this height is achieved on all four corners of the bed, the block and tackle pulley unit 308 may be engaged by pulling the rope on each of the corners to cause tensionable adjustment of the pliable support net 202, and hence, the position of the patient.

Although not shown in FIG. 3, an alternative embodiment may consist of a telescoping u-shaped bar that spans the width of the bed board 302. In another alternative embodiment, a pneumatic pump lift may be used to achieve an elevated position of the mechanical means. In yet another alternative embodiment, the mechanical means for causing tension on the support net 202 may be disposed on a telescoping or stationary elongated track disposed on the front wall 104 of the bed board 302. In still further alternative embodiments, the mechanical means for causing tensionable communication may be a winch or a gantry hoist.

Figure 4:
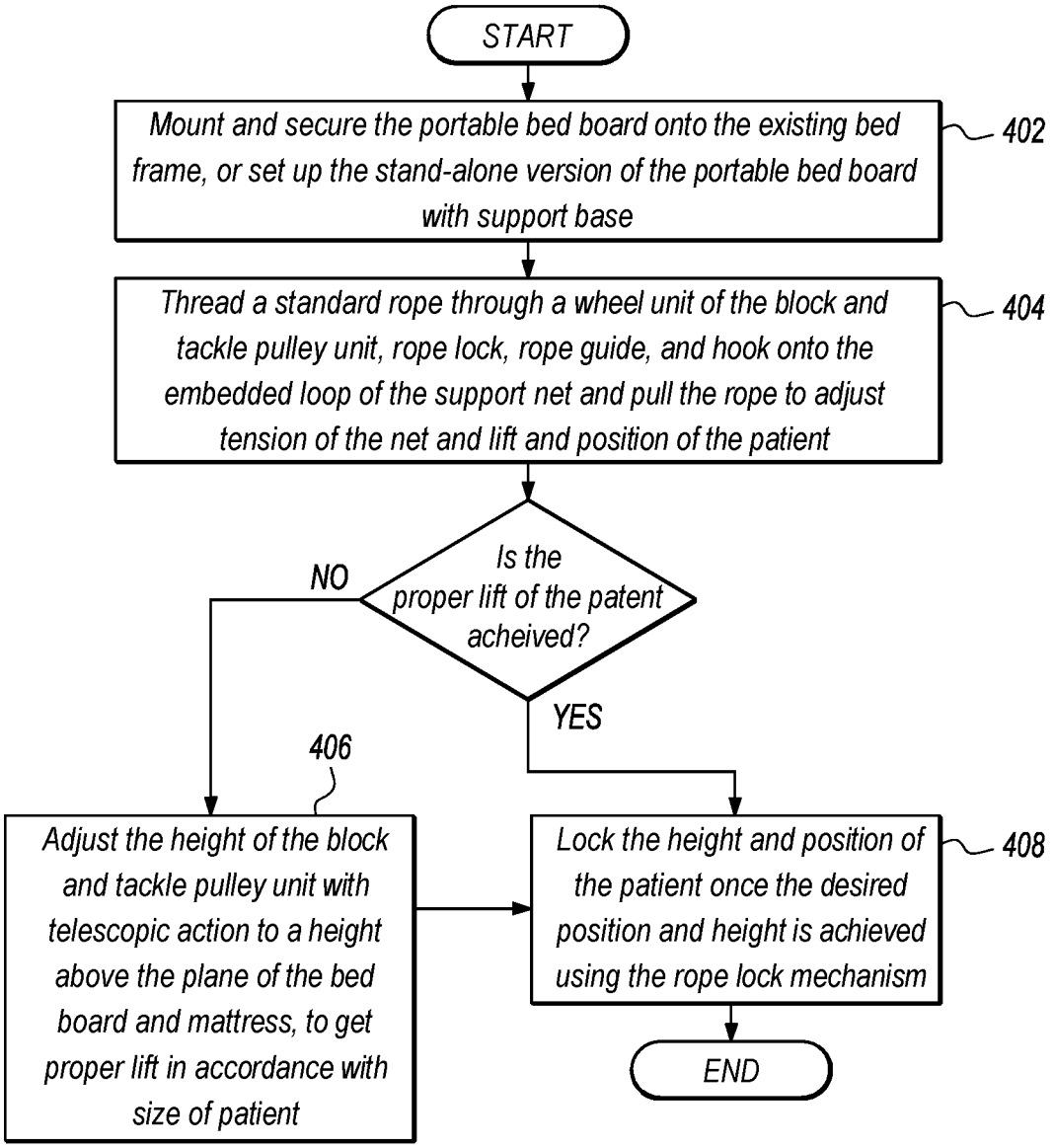
FIG. 4 shows a method flow chart according to aspects of the invention.

FIG. 4 shows a method of use for the portable prone position apparatus. The first step, 402, describes mounting and securing the portable, pre-assembled bed board 208 onto the existing bed frame 218. An inverted u-shaped clamp mount 204 may mount the top wall 102 of the bed board 208 with the existing bed frame 218. The clamp mount 204 may be an individual component disposed on the top wall 102 of the bed board 208 and dimensioned to house the base 220 for the telescopic arm 222 integrated with the block and tackle pulley unit 212. Other embodiments may include a clamp mount 204 integrated with the base 220 and block and tackle pulley unit 212 as a single integrated unit to be disposed on the top wall 102 of the bed board 208. Other embodiments may include clamp mounts 204 integrated with a stationary elongated member disposed with a block and tackle pulley unit 212. In yet other embodiments, not shown, the inverted u-shaped clamp mount may span the entire length of the top wall 102 of the bed board 208 and all of the clamp mount 204 embodiments mount over the top wall of the existing bed frame 218 and secured by bolt. The horizontally-spanning clamp mount may be integrated with a base and a housing for a telescopic inverted u-shaped bar disposed with the winch or hoist mechanical means for lift and adjustment of the patient. Other embodiments may include a horizontally-spanning clamp mount integrated with a base for a stationary inverted u-shaped bar disposed with the winch or hoist mechanical means for lift and adjustment of the patient. Both horizontally-spanning clamp mount embodiments may be mounted on the existing bed frame 218 by hanging over the top wall of the bed frame 218 and securing with bolts.

In an alternative embodiment, the portable bed board 208 may be mounted to a bed frame 218 with the use of a frame mount disposed on the back wall 216 and operably connected to an embedded loop 206 of a support net 202 through a block and tackle pulley 212. In the present example, the bed board 208 may be mounted on a bed frame, and easily un-mounted. The frame mount being configured to allow a flat surface of the back wall 216 of the bed board 208 to be disposed flush against a flat surface of an existing bed frame 218. Alternatively, the frame mount disposed on the back wall 216 of the bed board 208 may be configured with articulation to allow the bed board 208 to move in at least one axis of motion versus the flat surface of the existing bed frame 218.

In other examples, the bed board 208 may be fitted with a support base on the bottom wall 106 of the bed board 208, allowing for the bed board 208 to support the weight of a patient in a recumbent position, without the need for a bed or bed frame. In alternative embodiments, the components of the apparatus for an effortless transition to a prone position for patients suffering from Covid-19 or any other severe respiratory distress may be individually assembled onto an existing foot board and head board of a bed frame 218 directly, obviating the need for a pre-assembled portable bed board 208. The mechanisms for causing lift and positional shift of a patient may be the same irrespective of embodiments—pre-assembled bed boards or direct component assembly onto a bed frame.

Next, step 2 404 of the method of use of the portable prone position device in accordance with an exemplary aspect of the invention, describes threading a standard rope through a wheel unit 306 of the block and tackle pulley unit 212. The free end of the rope may then be guided through a corresponding rope guide 210 to be hooked onto its respective embedded loop 206 of the pliable support net 202 by means of a hook 226. In a preferred means for hooking the free end of the rope from the rope guide 210 to the embedded loop 206 of the support net 202 may be a caribbeaner. Other means may include an S-hook, rope knot, or any small form factor fastener. The patient resting on the support net 202 may have his or her position adjusted by pulling the rope threaded through a wheel unit 306 of a block and tackle pulley 212, which causes a change in tension in the pliable support net 202.

In continuing reference to FIG. 4, if the patient is heavy-set, then a user is directed to step 3 406, which describes adjusting the height of the block and tackle pulley units 212 to an elevation above the plane of the mattress and support net 202. In an exemplary embodiment, the block and tackle pulley unit 212 is disposed on a base 220 housed on the top wall 102 of the bed board 208 with a telescopic arm 222. The extension of which, allows for the raising and lowering of the block and tackle pulley unit 212, ranging from the top height of the bed board 208 to up to 3-5 feet above that height. The raising of the block and tackle pulley unit 212 allows for the stable support of a heavier-set patient laying in a recumbent position on the pliable support net 202, during the initial lift and manipulation of the patient's position by adjusting the tension on the pliable support net 202 by the block and tackle pulley unit 212. The base 220 housing the telescopic arm 222, coupled to the block and tackle pulley unit 212, may be disposed on the top wall 102 of the bed board 208 by an inverted u-shaped clamp 204. The raising of the telescopic arm 222 may be done manually by lifting the block and tackle pulley unit 212, and locking it in a desired vertical height by a pin and loop lock. Other embodiments may have an electro-mechanical means disposed on the base 220, top wall 102 of the bed board 208, or the front wall 104 of the bed board 208, for the raising and lowering of the telescopic arm 222 coupled to the block and tackle pulley unit 212.

Other embodiments may include a block and tackle pulley unit 212 may be coupled to a vertical track disposed on the front wall 104 of the bed board 208. The block and tackle pulley unit 212 may slide up and down in a vertical direction along the vertical track, that may extend as high as 3-5 feet above the top height of the top wall 104 of the bed board 208. The caregiver may manually adjust the height of the block and tackle pulley unit 212 along the vertical track, and then lock it in a preferred height using a pin and lock mechanism. Other embodiments may include an electromechanical means disposed on the top wall 102, front wall 104, or the block and tackle pulley unit 212 itself, for the raising and lowering of the block and tackle pulley unit 212 along the vertical track.

A power means may be disposed on the front wall 104 of the bed board 208, or may be integrated within the housing of the block and tackle pulley 212, and coupled to a control circuit. A control circuit may be disposed of on the front wall 104 of the bed board 208. Alternatively, a control circuit may be disposed of within the range of patient reach in order for a patient to control tension and adjustment of the support net 202 positions. In yet another alternative embodiment, the control circuit may be a user interface display, as part of a bed board display, user device display, console display, and hand-held device display. The control circuit may have a patient position library with a pre-defined program of user-specific actuation of the power means. In other embodiments, the control circuit may be integrated within a home or facility Internet of Things network or a remote server, in order to enable intelligent automation of the power device based on user-specific contextual data. For instance, a user may wear an accelerometer that relays patient movement data to inform the power device for actuation if necessary. Moreover, an RFID tag may be embedded within the wheel unit of the block and tackle pulley, relaying patient movement data to inform the power device for actuation if necessary.

If the patient is not heavy-set, then a user may bypass step 3 406 and is directed to step 4 408 of an exemplary aspect of the method of use. Step 4 408 describes locking the position of the patient with a rope lock mechanism once the desired height and position of the patient are achieved. The safety rope lock 310 be achieved with a load brake housed within a load brake fixture housed on the block and tackle system. In one embodiment, the user rapidly changes the direction of the rope activating the brake. Alternatively, the load brake may be applied when the user presses a switch or lever on the outer surface of the load brake fixture. There is also a release on the self-locking mechanism such that when the user wishes to release tension on the rope, the load brake is disengaged with a switch or lever. The rope then unfurls, and tension is released by the user to lower the patient back to the resting position. In other embodiments, the rope lock 310 may be disposed on the front wall 104 of the bed board 302.

Alternatively, the front wall 104 of the bed board 100 may house the rope locking mechanism 124 to lock the sliding of the rope, in order to prevent movement of the wheel unit 306 of the block and tackle pulley 116 and preserve the specific tautness of the pliable support net 130. Preserving the specific tautness of the pliable support net 130 will maintain the preferred position of the recumbent patient. The rope locking mechanism may be disposed on the front wall 104 of the bed board 100, situated below and in line with the block and tackle pulley 116. Other embodiments may include a bed board 100 with a rope locking mechanism 124 integrated within a rope guide 114. Alternatively, the rope locking mechanism 124 may be integrated within the housing of the block and tackle pulley 116, whereby a rope locking mechanism is in direct communication with the wheel unit 306 of the block and tackle pulley 116, or integrated within the housing of the block and tackle pulley 116 and not in direct communication with the wheel unit 306.

Figure 5:
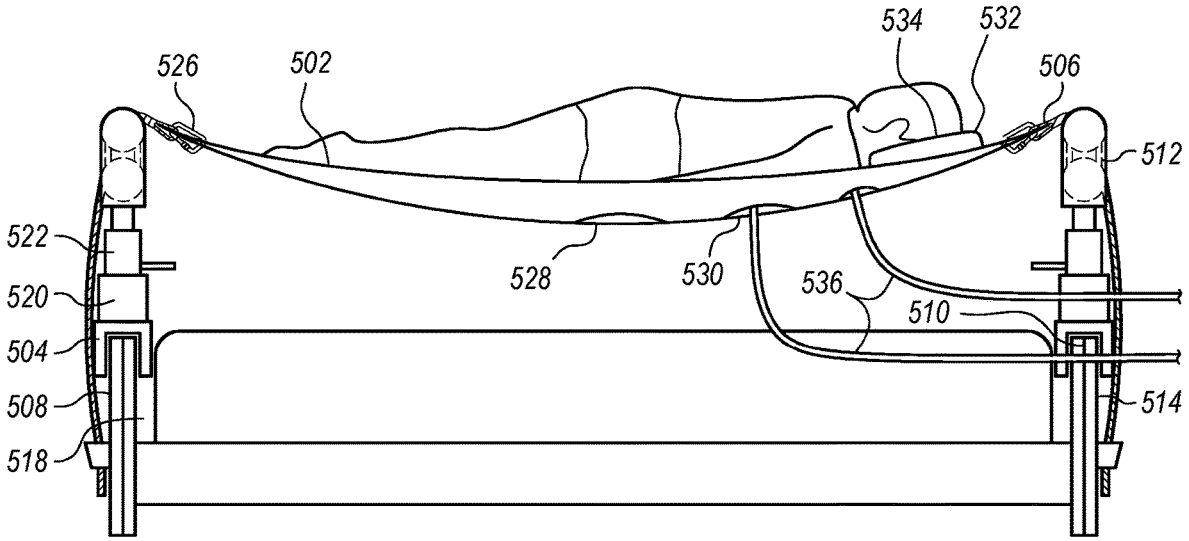
FIG. 5 shows a side view of the pronation apparatus according to aspects of the invention.

FIG. 5 shows a top elevation view of the apparatus, housing a patient in a prone position, in accordance with an aspect of the invention. The position of the support structure in relation to the bed board 508, along with a preferred configuration of embedded loop 506 and block and tackle 512 rope communication is shown. The support structure may be a net, mat, mattress, or any pliable surface fittingly disposed within existing bed boards, and or bed frames. In a primary embodiment, the support structure is a support net 502 fittingly disposed within an existing bed frame 516, whereupon each block and tackle 512 will rope communicate with its respective embedded loop 506—loading and unloading of tension on each corner of the support net 502, for stable and precise control of a prone patient.

As shown in FIG. 5, an exemplary embodiment of the pronation apparatus may include an inverted u-shaped clamp mount 504 to mount the top wall 510 of the bed board 508 with the existing bed frame 518. The clamp mount 504 may be an individual component disposed on the top wall 510 of the bed board 508 and dimensioned to house the base 520 for the telescopic arm 522 integrated with the block and tackle pulley unit 512. Other embodiments may include a clamp mount 504 integrated with the base 520 and block and tackle pulley unit 512 as a single integrated unit to be disposed on the top wall 510 of the bed board 508. Other embodiments may include clamp mounts 504 integrated with a stationary elongated member disposed with a block and tackle pulley unit 512. In yet other embodiments, not shown, the inverted u-shaped clamp mount may span the entire length of the top wall 510 of the bed board 508 and all of the clamp mount 504 embodiments mount over the top wall of the existing bed frame 518 and secured by bolt. Although not shown in FIG. 5, a horizontally-spanning clamp mount may be integrated with a base and a housing for a telescopic inverted u-shaped bar disposed of with the winch or hoist mechanical means for lift and adjustment of the patient. Other embodiments may include a horizontally-spanning clamp mount integrated with a base for a stationary inverted u-shaped bar disposed of with the winch or hoist mechanical means for lift and adjustment of the patient. Both horizontally-spanning clamp mount embodiments may be mounted on the existing bed frame 518 by hanging over the top wall of the bed frame 518 and securing with bolts.

While not shown in FIG. 5, the portable bed board 508 for the apparatus housing a prone patient, may be mounted to a bed frame 518 with the use of a frame mount disposed on the back wall and operably connected to an embedded loop 506 of a support net 502 through a block and tackle pulley 512. In the present example, the bed board 508 may be mounted on a bed frame 518, and easily un-mounted. The frame mount being configured to allow a flat surface of the back wall of the bed board 508 to be disposed flush against a flat surface of an existing bed frame 518. Alternatively, the frame mount disposed on the back wall of the bed board 508 may be configured with articulation to allow the bed board 508 to move in at least one axis of motion versus the flat surface of the existing bed frame 518.

In other examples, also not shown, the bed board 508 may be fitted with a support base on the bottom wall of the bed board 508, allowing for the bed board 508 to support the weight of a patient in a recumbent, supine, and, or prone position, without the need for a bed or bed frame. In alternative embodiments, the components of the apparatus for an effortless transition to a prone position for patients suffering from Covid-19 or any other severe respiratory distress may be individually assembled onto an existing footboard and headboard of a bed frame 518 directly, obviating the need for a pre-assembled portable bed board 508. The mechanisms for causing lift and positional shift of a patient may be the same irrespective of embodiments—pre-assembled bed boards or direct component assembly onto a bed frame.

In continuing reference of FIG. 5, the pliable support net 502 of the pronation support may have reinforced embedded loops 506 on the corners of the support net 502, wherein the loops 506 have dimension to hook a rope terminus in order for the embedded loops 506 to be in tensionable communication with the block and tackle pulley 512. The tensionable communication allows for a user or care giver to mechanically adjust the tautness of the support net 502 by pulling the rope threaded over the wheel unit of the block and tackle pulley 512, and hence, the position of a recumbent, supine, and, or prone patient. In alternate embodiments, an electromechanical means may be disposed on the front wall 504 of the bed board 508, allowing for a mechanized means for delivering the tensionable communication to the support net 502.

In a preferred embodiment, a user may secure the bed board 508 to a bed frame 518 with the use of a frame mount or clamp mount 504. The user may thread a standard rope through one block and tackle pulley 512 and align the rope within an inlet of the wheel unit. The free end of the rope may then be guided through a corresponding rope guide to be hooked onto its respective embedded loop 506 of the pliable support net 502 by means of a hook 526. In a preferred means for hooking the free end of the rope from the rope guide to the embedded loop, 506 of the support net 502 may be a caribbeaner. Other means may include an S-hook, rope knot, or any small form factor fastener. The patient resting on the support net 502 may have his or her position adjusted by pulling the rope threaded through a wheel unit of a block and tackle pulley 512, which causes a change in tension in the pliable support net 502.

Although not shown in FIG. 5, a rope locking mechanism housed on the front wall 504 of the bed board 508 locks the movement of the rope, and hence the wheel unit of the block and tackle pulley 512. In alternative arrangements, the rope locking mechanism may be disposed within the housing of the block and tackle pulley 512. Based on manipulation of the rope from any of the four block and tackle pulleys 512, each housed on each corner of the bed board 508, or mounted on each corner of the top wall 502 of the bed board 508, the lift and adjustment of support net 502 may be effectuated with stability and exact precision.

While not shown in FIG. 5, alternative embodiments may include a user securing a bed board 508 with adjustable height to an existing foot board and head board of a bed frame. Adjusting height may be caused by a longitudinal member housed within the side walls, of the bed board 508 that may be extended to match the height of the existing bed frame. Adjusting height may also be caused by a horizontal member housed within the bottom wall of the bed board 508, extending to match the dimensions of a bed frame. In yet another embodiment, adjusting height may be caused by a horizontal member adjoined to a base with a large surface area, housed within the bottom wall of the bed board 508, extending to match the dimension of a bed frame. Other embodiments may include a user configuring the bed boards 508 with an extending base portion from the bottom wall without the need for an existing bed frame or mattress. The extending base portion has a large enough surface area and counter-weight in order to support the weight of a patient—recumbent, supine, or prone—even without the need for the bed board 508 to be secured to an existing bed frame or mattress.

In an exemplary embodiment, as shown in FIG. 5, a block and tackle pulley unit 512 that is disposed on a base 520 housed on the top wall 510 of the bed board 508 with a telescopic arm 522 may be included. The extension of which, allows for the raising and lowering of the block and tackle pulley unit 512, ranging from the top height of the bed board 508 to up to 3-5 feet above that height. The raising of the block and tackle pulley unit 512 allows for the stable support of a heavier-set patient laying in a recumbent, supine, or prone position on the pliable support net 502 by adjusting the tension on the pliable support net 502 by the block and tackle pulley unit 512. The base 520 housing the telescopic arm 522, coupled to the block and tackle pulley unit 512, may be disposed on the top wall 510 of the bed board 508 by an inverted u-shaped clamp 504. The raising of the telescopic arm 522 may be done manually by lifting the block and tackle pulley unit 512, and locking it in a desired vertical height by a pin and loop lock. Other embodiments may have an electro-mechanical means disposed on the base 520, top wall 510 of the bed board 508, or the front wall 514 of the bed board 508, for the raising and lowering of the telescopic arm 522 coupled to the block and tackle pulley unit 512.

Although not shown in FIG. 5, the block and tackle pulley unit 512 of the pronation apparatus may be coupled to a vertical track disposed on the front wall 514 of the bed board 508. The block and tackle pulley unit 512 may slide up and down in a vertical direction along the vertical track, which may extend as high as 3-5 feet above the top height of the top wall 514 of the bed board 508. The caregiver may manually adjust the height of the block and tackle pulley unit 512 along the vertical track, and then lock it in a preferred height using a pin and lock mechanism. Other embodiments may include an electromechanical means disposed on the top wall 510, front wall 514, or the block and tackle pulley unit 512 itself, for the raising and lowering of the block and tackle pulley unit 512 along the vertical track.

Also not shown in FIG. 5, alternate embodiments may include users securing the individual components of the prone position device directly on the foot board and head board of a bed frame, obviating the need for a bed-board 508. In such an embodiment, a user may secure components, such as the rope guide, block and tackle pulley 512, clamp mounts 504 or frame mounts, hooks 526 for communicating with the embedded loop 506 of a support net 502, rope locking mechanism, telescopic base 520, and telescopic arm 522. In still a further embodiment, the tension-causing mechanism is similar to those of the bed-board embodiments of the apparatus, whereby a rope is threaded through a wheel unit of a block and tackle pulley 512 and operably connected to an embedded loop 506 of a pliable support net 502.

In alternate embodiments, also not shown in FIG. 5, the tension of the support net 502 may be caused by a wheel unit of the block and tackle pulley 512 coupled to power means. A power means may be disposed on the front wall 514 of the bed board 508, or may be integrated within the housing of the block and tackle pulley 512, and coupled to a control circuit. A control circuit may be disposed of on the front wall 514 of the bed board 508. Alternatively, a control circuit may be disposed of within the range of patient reach in order for a patient to control tension and adjustment of the support net 502 positions. In yet another alternative embodiment, the control circuit may be a user interface display, as part of a bed board display, user device display, console display, and hand-held device display. The control circuit may have a patient position library with a pre-defined program of user-specific actuation of the power means. In other embodiments, the control circuit may be integrated within a home or facility Internet of Things network or a remote server, in order to enable intelligent automation of the power device based on user-specific contextual data. For instance, a user may wear an accelerometer that relays patient movement data to inform the power device for actuation if necessary. Moreover, an RFID tag may be embedded within the wheel unit of the block and tackle pulley, relaying patient movement data to inform the power device for actuation if necessary.

Still in reference to FIG. 5, the pliable support net 502 housing a prone patient may be comprised of pliable, elastomeric, and hypo-allergenic material. The pliable support net 502 may be open mesh, or a contiguous mat, and the mesh or mat size thereof, must be such as to allow the mat or net to conform to the shape of the patient. The net or mat may be a made of a heat-settable thermoplastic material with "memory" such that it does not take a substantially permanent formation under a specific patient load or position. In another embodiment, the pliable support net 502 may be comprised of any material resulting from the polymerization of chloroprene. For instance, in one embodiment, the support net 502 may be comprised of a neoprene-like substance.

In one embodiment, the support net 502 of the prone device may have at least one aperture 528 in designated regions of the support net 502. Apertures 528 serve to alleviate contact pressure in regions traditionally associated with decubitus ulcers: sacrum, lumbar, trochanter, gluteal, and heel/foot regions, etc. Designated apertures 528 of varying sizes may accommodate patients of varying sizes. Additionally, support nets 502 may have varying size to accommodate patients of varying sizes, along with beds of varying sizes. Alternate aspects of the invention may be for a pliable support net 502 with multiple apertures 528 corresponding to the aforementioned contact pressure regions. In other alternate aspects, the pliable support net 502 may appear as one contiguous piece, comprising at least one break-away aperture 528 located at a designated contact pressure region. In this embodiment, care givers could have the choice of removing break away apertures 528 as the care giver sees fit. In yet other embodiments, the tensile strength of the support net 502 may vary across the surface of the net 502, depending on the load-bearing regions.

In a preferred embodiment of the support net 502 configured to support pronation, apertures 530 may also be included that are dimensioned for the traversal of vital tubing and lines in order for a prone patient to be in operable communication with medical monitoring or administering devices, without the risk of tubing or line dislodgement. The support net 502 may have apertures 530 for a Foley catheter and central venous catheter. Central venous catheters include subclavian, femoral, or internal jugular catheters. All tubing or lines are able to extrude from the support net 502 safely during pronation. Additionally, the pronation support net 502 may have indentations or tracks impressed on the patient-side surface of the support net 502 in order to guide a line or tube from the prone patient to a medical monitoring or therapeutic delivery device. Additionally, the support structure further comprises guide tracks impressed upon patient-side surface of the support structure, whereby the vital lines or vital tubes are fittingly disposed within the guide tracks, thereby preventing dislodgment of the vital lines and vital tubes from the patient to any one of the monitoring and therapeutic devices.

In a preferred embodiment, the tubing or line apertures 530 on the pliable support net 502 may comprise of apertures 530 which may have adjustable diameters, depending on the size of the traversing tube or line. The diameter of the aperture may be adjusted by zipping, clipping, buttoning, wiring, stringing, Velcro attaching, or magnet attracting 2-panel or 4-panel flaps that cover the aperture 530. During complete opening of the aperture 530, the flap panels may be completely unwound by any of the above-mentioned fastening means. Conversely, the aperture 530 may be completely closed by winding up the flap panels into a closed state by any one of the above-mentioned fastening means. Intermediate states of aperture 530 opening or closing may be achieved by partial winding up or down of the flap panels using any one of the abovementioned fastening mechanisms. Alternatively, a single flap situated along any portion of the perimeter of the aperture 530, deploying any one of the above fastening attachments, may be used to seal the aperture during non-traversal. Further yet, the aperture dimensioned to traverse any one of vital tubes or vital lines is further configured to traverse any one of, or combination of, a foley catheter, central venous catheter, and endotracheal tube.

In continuing reference to the support net 502 of the pronation apparatus, the net may be impregnated, coated, embedded, lined, or double layered with an antibiotic of proven safety and efficacy. The antibiotic may be coupled with cream, or other viscous material, for the uniform distribution over the surface of the net 502. Additionally, in an alternative embodiment, the support net 502 may be impregnated, coated, embedded, lined, double layered, or spread with any ulcer therapeutic or prophylactic of proven safety and efficacy.

In a preferred embodiment, the pliable support net 502 may have reinforced embedded loops 506 on the corners of the support net 502, wherein the loops 506 have the dimension to hook a rope terminus in order for the embedded loops 506 to be in tensionable communication with the block and tackle pulley 512, or other mechanical means. The means for hooking a rope terminus to the embedded loop 506 may be a carabineer, S-hook, or any loop clamping means. The tensionable communication allows for a user or caregiver to mechanically adjust the tautness of the support net 502 by pulling the rope threaded over the wheel unit of the block and tackle pulley 512, and hence, the position of a recumbent, supine, or prone patient. In alternate embodiments, an electro-mechanical means may be disposed on the front wall 514, or top wall 510 of the bed board 508, allowing for a mechanized means for delivering the tensionable communication to the support net 502. In both embodiments, the tensionable communication provides the lift and rotation of a patient—with sufficient intervening space between the support net and mattress—preventing surface contact and thus, preventing or mitigating decubitus ulcers and an apparatus for an effortless transition to a prone position for patients suffering from SARS-CoV-2 or any severe respiratory distress.

In final reference to FIG. 5, a head support 532 further comprising an aperture 534 for exposing a patients face, while in the prone position, may be affixed. Such head support aperture 534 may also have the same variable diameter and sealing options as mentioned above, using identical fastening mechanisms. The aperture 534 may be dimensioned for the passage of any one of a vital tube or line extending from any one a head, neck, and throat region of a patient, in operable communication with any of a medical monitoring or therapeutic device. The head support 532 itself may be affixed to the bed board 508 by means of an interlocking belt and clip, or by any of the fastening mechanisms mentioned above. This allows patients or care-takers to remove the head support for cleaning or maintenance. Alternatively, the head support 532 may be affixed to the support net 502 directly, or the bed frame 518, by means of similar interlocking means.

Figure 6:
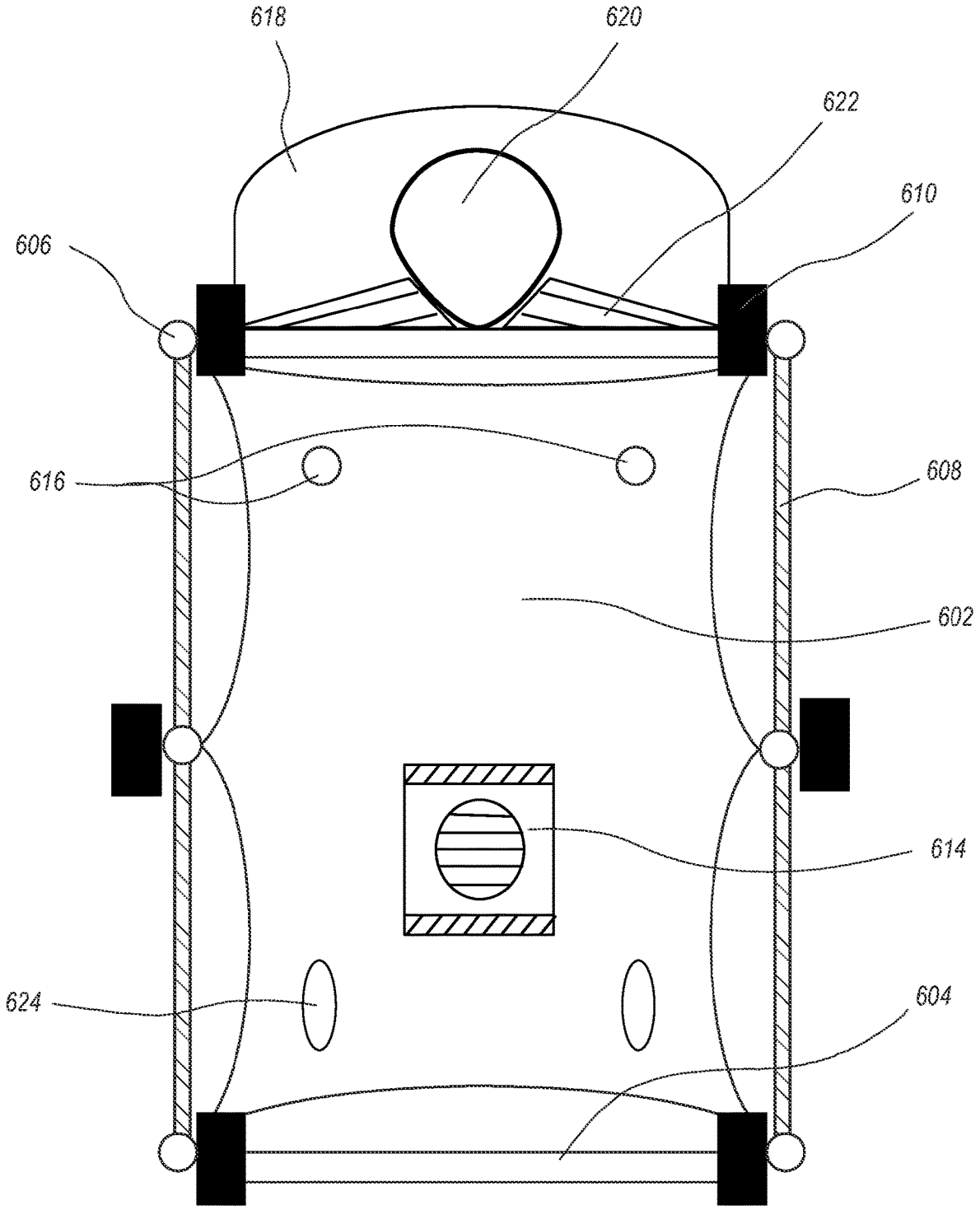
FIG. 6 shows an exemplary embodiment of the apparatus according to aspects of the invention.

Now in reference to FIG. 6. FIG. 6 shows a top elevation view of the pronation support structure in accordance with an aspect of the invention. The figure shows the position of the support structure in relation to the bed board 604, along with a preferred configuration of embedded loop 606, side-rails 608, and block and tackle 610. The rope and rope communication is not shown for purposes of illustrating the pronation support structure and the configuration of apertures disposed within.

In a primary embodiment, the pronation support structure is a support net 602 fittingly disposed within an existing bed board 604, whereupon each block and tackle 610 may rope communicate with its respective embedded loop 606—loading and unloading of tension on each corner of the support net 602. Alternatively, the support structure may be a mat, cushion, or any pliable material that may support the weight of a patient for lift and, or rotation from the surface of a bed mattress. Moreover, in some embodiments, the support structure or support net 602 may be hypo-allergenic. In yet other embodiments, the support structure or support net 602 may be embedded or coated with an antibiotic agent.

In some embodiments, as shown in FIG. 6, side rails 608—composed of any one of, or combination of, plastic, metal, or natural material—may surround the perimeter of the bed, thereby allowing for additional reinforcement for heavier set patients. For instance, the presence of the side rails 608 may prevent the rolling over of a prone patient. In addition, the side rails 608 may be fitted on each side with an additional block and tackle pulley 610—equidistant from each bed board 604—in operable communication with an embedded loop 606 disposed on each length side of the support net 602 and equidistant from each of the corner embedded loops 606. The rail-fitted side block and tackle 610 in rope communication with the side embedded loops 606 of the support net 602 provide for the stable and precise control of a heavier set patient in the prone position. Alternatively, the side block and tackle 610 may be fitted to a side bed board 604 or directly to the side of the bed frame, without the need for side-rails 608.

In continuing reference to FIG. 6, a plurality of apertures may be configured to relieve stress, as well as traverse specific tubing or lines from a patient to a monitoring or therapeutic device. Depending on the utility or function of the tubing or line, the location and dimension of the aperture may vary.

While not shown in FIG. 6, in one embodiment, an aperture may be configured and dimensioned to expose any one of a number of regions associated with decubitus ulcers, more commonly referred to as bed sores. In other embodiments, additional apertures may be disposed on the support net 602 to accommodate a prone patient to be in operable communication with a monitoring or therapeutic device. In yet other embodiments, such apertures may be disposed on a support net 602, without the presence of the stress-relieving aperture or apertures.

As illustrated in FIG. 6, a foley catheter aperture 614 may be disposed of in the mid-portion of the support net 602, corresponding to the mid-section or trunkal region of a patient. The aperture is configured and dimensioned to traverse a foley catheter—a flexible tubing passed through the urethra and into the bladder of a patient in order to drain urine—during pronation. In other embodiments, other common types of indwelling tubing or catheter may be used to traverse the aperture.

Additionally, as shown in FIG. 6, the foley catheter aperture 614 or any aperture may be coupled with a covering or patch that may be sealed over the aperture, using any number of sealing mechanisms. The aperture may be further coupled to at least one sealing flap with a fastening attachment, whereby the aperture may be sealed, opened, or partially ajar via a fastening attachment on a ventral side of the at least one flap interlocking with a corresponding counter-attachment on a dorsal side of the at least one opposably paired flap. Various fastening attachments may be used, such as a Velcro-attachment, button, zipper, or clip to seal close the aperture during non-use. However, apertures may also not be coupled with a covering or patch, and rather, just remain open during non-use.

In a preferred embodiment, the support net 602 may also be disposed with diametrically opposed central venous catheter apertures 616, wherein each aperture is disposed on the top portions of the support net 602, corresponding to the left or right chest region of a patient. The aperture is configured and dimensioned to traverse a central venous catheter for internal jugular or subclavian access. Alternatively, the central venous catheter aperture 616 may be configured as a single large aperture, as opposed to two distinct, laterally opposed apertures. While not shown in FIG. 6, other indwelling tubing or catheter may be used to traverse the aperture, and patches or covers may be coupled to the aperture for sealing during non-use.

FIG. 6 also illustrates a head support 618 disposed with at least one aperture for exposing a face of the patient in a prone position and configured to traverse any one of a tube or line from any one of a head, neck, and throat of the patient. As shown in FIG. 6, the aperture disposed within the head support 618 may be an endotracheal tube aperture 620, configured to traverse an endotracheal tube. The endotracheal tube is inserted either in the mouth or nose of a patient and the tubing may be slidably disposed within the endotracheal tube aperture 620 and operably connected to the therapeutic or monitoring device. The aperture may have a seal, or may not have a seal. Additionally, other tubes, lines, or leads may traverse the aperture. In one embodiment, the head support may further comprise a fastening attachment, whereby the head support is secured on the support structure via the head support fastening attachment interlocking with a corresponding counter-attachment. In yet other embodiments, the head support may have indentations or tube guides 622, guiding the endotracheal tubes or any other tubes, lines, or leads from a patients head, ear, neck, or throat.

In continuing reference to FIG. 6, the support net 602 may comprise at least a single stress-relief aperture 624 configured for relieving or preventing decubitus ulcers. Other embodiments may not comprise stress-relief apertures 624, but instead, just apertures for the traversal of catheters, tubes, lines, or leads.

While not illustrated in FIG. 6, a pneumo-thorax aperture may be configured and dimensioned to traverse any one of a catheter, line, tube, or lead from a ventral portion of the thorax region from a prone patient. The thorax is preferentially exposed for allowing free respiratory movement. Normal inspiration and expiration without hindrance by any of the lines, leads, tubes, straps, or other components of the support net 602 may be achieved.

Therefore, the forgoing is considered as illustrative and descriptive of a number of embodiments covering the novel aspects of a pronation device for an effortless transition for patients suffering from Covid-19 or any severe respiratory distress syndrome, and it is not intended to be limited to the details shown, since various modifications and structural changes may be made without departing in any way from the spirit of the present invention.

I claim:

1. An apparatus for an effortless transition to a prone position for patients suffering from SARS-CoV-2 comprising:

a support structure with at least one pair of opposable embedded loops and at least one aperture dimensioned to traverse any one of vital lines from a patient in operable communication with any one of, or combination of, a monitoring and/or therapeutic device, thereby preventing dislodgement of said vital lines;

at least one block and tackle pulley;

at least one rope lock mechanism integrated as part of a rope guide or the at least one block and tackle pulley;

at least one mount for securing the at least one block and tackle pulley with an existing bed board, wherein the at least one mount is an inverted U-shaped mount configured to securely rest on the existing bed board; and said support structure in communication with the at least one block and tackle pulley mounted on the bed board via a rope through the at least one pair of opposable embedded loops, enabling lift or rotation of the support structure enabling supination or pronation of the patient.

2. The apparatus of claim 1, wherein the at least one block and tackle pulley is coupled to a telescopic member disposed on a wall of the bed board, thereby when elevated, elevating the height of the at least one block and tackle pulley and tensionable engagement with the support structure via the at least one pair of opposable embedded loops.

3. The apparatus of claim 1, wherein the support structure further comprises at least one stress-relief aperture and is in tensionable communication with the at least one block and tackle pulley by a rope threaded through said at least one block and tackle pulley and hooked to the embedded loop of the support structure by an attachment.

4. The apparatus of claim 1, wherein the support structure further comprises an embedded or surface-coated antibiotic agent for prevention or mitigation of decubitus ulcers or any other open wound.

5. The apparatus of claim 1, wherein the support structure further comprises material resulting from a polymerization of chloroprene.

6. The apparatus of claim 1, wherein the support structure further comprises any one of a hypoallergenic material.

7. The apparatus of claim 1, wherein the support structure further comprises guide tracks impressed upon a patient-side surface of the support structure, whereby the vital lines or vital tubes are fittingly disposed within the guide tracks, thereby preventing dislodgment of the vital lines and vital tubes from the patient to any one of the monitoring and therapeutic devices.

8. The apparatus of claim 1, wherein the at least one aperture is dimensioned to traverse any one of vital tubes or vital lines is further configured to traverse any one of, or combination of, a foley catheter, central venous catheter, and endotracheal tube.

9. The apparatus of claim 1, further comprising a head support disposed with at least one aperture for exposing a face of the patient in a prone position and configured to traverse any one of a tube or line from any one of a head, neck, and throat of the patient.

10. The apparatus of claim 9, wherein the head support further comprises a fastening attachment, whereby the head support is secured on the support structure via the head support fastening attachment interlocking with a corresponding counter-attachment.

11. An apparatus for an effortless transition to a prone position for patients suffering from a severe SARS-CoV-2/severe respiratory distress comprising:

a support structure configured to fold along any point or series of points and with at least one pair of opposable embedded loops;

a bed-board mounted on an existing bed-board or bed frame; and a block and tackle pulley mounted on the bed-board and in communication with the support structure via a rope through the at least one pair of opposable embedded loops on the support structure, enabling any one of lift or rotation of any point or series of points along the support structure enabling any one of supination or pronation of the patient.

12. A method for an effortless transition to a prone position for patients suffering from a severe respiratory distress comprising the steps of:

securing a block and tackle pulley onto at least one of a bed board, existing bed board, or existing bed frame with a use of at least one mount;

threading a rope through the block and tackle pulley;

guiding a free end of the rope through at least one rope guide;

attaching the free end of the rope with a clamp or hook;

hooking the clamp or hook to an embedded loop of a support structure housing a patient in a prone position;

adjusting the height and/or rotation of the support structure along any point or series of points of the support structure by pulling the rope threaded through the pulley and in tensionable communication with the support structure; and maintaining the height and/or rotation of the support structure using a rope locking mechanism, preventing the movement of the rope communicating the block and tackle pulley with the support structure, enabling supination or pronation of the patient.

13. The method of claim 12, further comprising the steps:

securing a bed board with a weight-bearing base, whereby the bed board is configured to support weight of a patient without the need of a bed frame or mattress creating a free-standing apparatus;

threading a rope through at least one block and tackle pulley on the bed board;

guiding a free end of the rope through at least one rope guide;

attaching the free end of the rope with a rope or clamp;

hooking the rope or clamp to an embedded loop of a support structure housing a patient;

adjusting the position of the patient by pulling the rope threaded through the at least one pulley and in tensionable communication with the support structure, and maintaining the position of the patient by locking a wheel unit of the at least one block and tackle pulley with use of a rope locking mechanism.

14. The method of claim 13, further comprising the step of:

coupling the at least one block and tackle pulley with a telescopic member disposed on a wall of the bed board, thereby when elevated, elevating the height of the at least one block and tackle pulley and tensionable engagement with the support structure via the embedded loop.

15. The method of claim 13, further comprising the step of:

traversing at least one aperture on the support structure with any one of a vital line or tube in order for the patient to be in operable communication with any one of a medical monitoring device or therapeutic device, thereby preventing dislodgement of said vital line or tube.

16. The method of claim 13, further comprising the step of:

guiding any one of a vital line or tube through at least one track impressed on the support structure and dimensioned to fittingly house and guide said vital line or tube to any one of a medical monitoring device or therapeutic device.

17. The method of claim 13, further comprising the step of:

sealing and opening of variable degree any one of an aperture on the support structure with at least one flap with any one of a fastening attachment.

* * * * *